United States Patent [19]

Dumoulin et al.

[11] Patent Number: 4,860,524

[45] Date of Patent: Aug. 29, 1989

[54] RIDING SADDLE AND METHOD OF MANUFACTURE

[75] Inventors: Patrick Dumoulin, Bourron-Marlotte; Hugues Recalt, Villenave D'Ornon, both of France

[73] Assignee: Anciens Etablissements Warin Fils BWF, Evry, France

[21] Appl. No.: 94,424

[22] Filed: Sep. 9, 1987

[30] Foreign Application Priority Data

Sep. 12, 1986 [FR] France ..... 86 12809

[51] Int. Cl.[4] ..... B68C 1/02

[52] U.S. Cl. ..... 54/44

[58] Field of Search ..... 54/37, 44

[56] References Cited

U.S. PATENT DOCUMENTS

| | | | |
|---|---|---|---|
| 3,286,440 | 11/1966 | Walker et al. | 54/44 |
| 3,371,467 | 3/1968 | Salisbury, III | 54/44 |
| 3,529,402 | 9/1970 | Queen | 54/44 |

FOREIGN PATENT DOCUMENTS

| | | | |
|---|---|---|---|
| 2133034 | 1/1973 | Fed. Rep. of Germany | 54/44 |
| 2525201 | 10/1983 | France . | |
| 85/05093 | 11/1985 | PCT Int'l Appl. | 54/44 |
| 1439761 | 6/1976 | United Kingdom | 54/44 |

*Primary Examiner*—Robert P. Swiatek

*Attorney, Agent, or Firm*—Dennison, Meserole, Pollack & Scheiner

[57] ABSTRACT

The invention relates to a riding saddle comprising a molded tree of composite material placed between two molded parts of cellular plastic material which constitute the seat and the underside of the saddle respectively. The tree (20) is formed as a single part comprising a thin strip of composite material and including a rigid arch (22) which is terminated at its front side ends by flexible flat tabs or "points" (30), together with a rear portion (32) in the form of a curved U-shape which includes zones (B, C) of flexibility for adapting to the shape of a horse's back.

16 Claims, 5 Drawing Sheets

RIDING SADDLE AND METHOD OF MANUFACTURE

The invention relates to a riding saddle of the type comprising a tree mounted between two thicknesses of flexible plastic material respectively constituting the seat and the underside of the saddle, and also to a method of manufacturing said saddle.

BACKGROUND OF THE INVENTION

Conventional saddles generally include a rigid tree made of metal, or of metal-reinforced wood, or perhaps of synthetic material, with webbing stretched thereover to support a traditional covering of leather which may be fixed to the tree by tacking (for example). The tree should normally be sufficiently rigid to ensure that the withers of the horse are permanently disengaged while simultaneously maintaining the saddle in shape, with the tree constituting the frame of the saddle. A saddle including such a tree is thus, by its very nature, incapable of adapting either to the morphology of the horse, or else to the morphology of the rider. That is why, in conventional saddles, the shape of the tree is a compromise between the various possible shapes of the backs of horses, and a given type of saddle is sometimes provided in several different sizes corresponding to different sizes of rider.

The drawbacks of such saddles stem from their structure: either the tree is rigid enough to ensure that the withers are left free and to retain the shape of the saddle, in which case the weight of the rider is not necessarily evenly distributed over the back of the horse to the detriment of the rider's equilibrium, or else the tree is relatively flexible, in which case the saddle deforms under the weight of the rider and the tree may come into contact with the withers. There is thus a tendency to prefer a saddle having a rigid tree with padding and stuffing applied thereto in order to ensure that the saddle bears properly onto the horse's back and also in order to improve the rider's equilibrium.

These conventional solutions nevertheless suffer from drawbacks specific thereto, since they increase the weight and the thickness of the saddle and they move the rider further away from the horse's back which is detrimental to rider stability and equilibrium.

In order to mitigate these drawbacks, French patent number 83 13 317 proposes a solution which is very different from traditional techniques, whereby a tree which is rigid but which is also thin and as light as possible is placed between two molded parts of a cellular plastic material which is light, shock absorbing, and non-slip, said parts respectively constituting the seat and the underside of the saddle. A saddle of this type provides improved rider equilibrium by virtue of its reduced thickness and its non-slip properties, and it also adapts more easily than a conventional saddle to the morphology of the rider and to the morphology of the horse by virtue of the flexibility of its upper and lower parts made of plastic foam. However, over its entire length, the rigidity of the tree counteracts this flexibility and serves essentially, as in traditional saddles, to ensure that the withers are left free and is itself incapable of adapting to the morphology of the horse or to the morphology of the rider.

Preferred embodiments of the present invention provide a new saddle which avoids the drawbacks of conventional rigid-tree saddles while retaining their advantages.

SUMMARY OF THE INVENTION

The present invention provides a riding saddle, wherein a tree including a rigid arch is mounted between two thicknesses of flexible plastic material, one of which constitutes the seat and the other of which constitutes the underside of the saddle and includes the flaps, the saddle being characterized in that the tree is formed in one piece by a thin strip of composite material which is rigid and substantially undeformable over the major portion of the tree, in particular at the arch, and which has controlled flexibility in predetermined zones in order to adapt to the morphology of a horse.

A saddle in accordance with the invention thus makes it possible to combine the advantages of saddles having a flexible tree with the advantages of saddles having a rigid tree, while avoiding their drawbacks. By virtue of its rigid arch, the tree ensures that the horse's withers are left permanently disengaged while in other, specified zones, the flexibility of the tree allows it to adapt automatically to the shape of the horse's back, under the effect of the rider's weight, and allows the rider's weight to be uniformly distributed over the horse's back. Two of the predetermined flexibility zones in the tree are situated at the "points" (i.e. The front side ends of the arch) which constitute flexible flat tabs applied against the underflaps of the saddle.

The flexibility of these flat tabs formed at the points of the tree serves to enable them to open outwardly or to close inwardly as a function of the shape of the horse's back, and also enables them to a certain extent to follow the deformations of the saddle while the horse is moving.

The tree of a saddle in accordance with the invention may be very short, in which case the top and bottom rear portions of the saddle are the portions which have relative rigidity suitable for holding the saddle in shape, and which, by virtue of being made of cellular plastic material, are suitable for adapting to the morphologies of the rider and of the horse.

The tree may also be relatively long, as in a traditional saddle. In this case, it includes a rear portion which is integrally molded with the arch and which is substantially in the form of a rigid curved U-shape with flat branches whose ends are connected to the arch via zones of determined flexibility about respective transverse axes in order to adapt to the curvature of the horse's back along its spine.

Further, the rear end of the tree which is generally in the form of a curved U-shape includes a middle zone of determined flexibility about the longitudinal axis of the saddle in order to enable it to adapt to the width of the horse's back.

The dimensions, i.e. The length and the width, of such a tree are smaller than the dimensions of the seat of the saddle. The top portion of the saddle made of cellular plastic material thus overhangs considerably around the rear portion of the tree and, by virtue of its flexibility, is capable of adapting automatically to the rider's morphology.

In a preferred embodiment of the invention, the tree is constituted by superposed layers of fibers which are assembled and bound together by a thermo-setting resin such as an epoxy resin.

For example, the tree may comprise layers of cloth made of a base fiber such as glass fiber together with layers of cloth made of reinforcing fiber such as carbon fiber, for example. The flexible zones or portions of the tree are defined, relative to the rigid zones to which they are connected, by omitting the reinforcing fibers and by reducing the number of layers of base fibers, and/or by orienting the base fibers at a special angle, e.g. at 45° relative to the desired flexibility axis.

After the tree has been made, the top portion of the saddle made of flexible plastic material is locally fixed to the tree and to the bottom portion of the saddle, e.g. by gluing.

In a variant, the plastic material of the top and bottom portions of the saddle may be molded directly over the tree.

Preferably, the inside faces of these two saddle portions include cavities or recesses suitable for receiving and positioning the tree.

Further, in particular when using a short tree, the inside face of the seat-forming portion of the saddle includes longitudinal ribs and/or cavities conferring determined rigidity thereto, and said cavities may optionally be filled with an injected rigid plastic material.

A saddle in accordance with the invention may additionally include padding of flexible material fixed on the underflaps of the saddle and covering and closing hollow pockets formed in the underflaps for receiving the points of the tree.

This prevents the points from escaping from the pockets formed in the flaps whenever the saddle is deformed, i.e. by tearing through the plastic material from which the pockets are made.

The invention also provides a method of manufacturing such a saddle including a molded tree of composite material, the method being characterized in that it consists in successively placing various different layers of base fiber cloth and of reinforcing fiber cloth impregnated with a thermo-setting resin and cut to the desired shapes and sizes in a mold having the shape of the tree to be obtained, said layers of cloth being disposed at predetermined locations with predetermined fiber orientations corresponding to the zones of rigidity and to the zones of flexibility that are to be obtained, in subsequently compressing or compacting together the layers in the mold, and in polymerizing the resin.

In accordance with another characteristic of the invention, this method also consists in making the top and bottom portions of the saddle by thermo-compression molding of at least one cellular plastic material, e.g. polyethylene, having a layer of coating material such as towelling over at least one face thereof.

A saddle in accordance with the invention is much thinner and lighter than a traditional leather saddle, it is considerably cheaper, and it possesses intrinsic qualities which have heretofore not been available in traditional saddles.

BRIEF DESCRIPTION OF THE DRAWINGS

Other characteristics, details, and advantages of the invention appear more clearly from reading the following description given by way of example with reference to the accompanying drawings, in which.

MORE DETAILED DESCRIPTION

Figure 1:
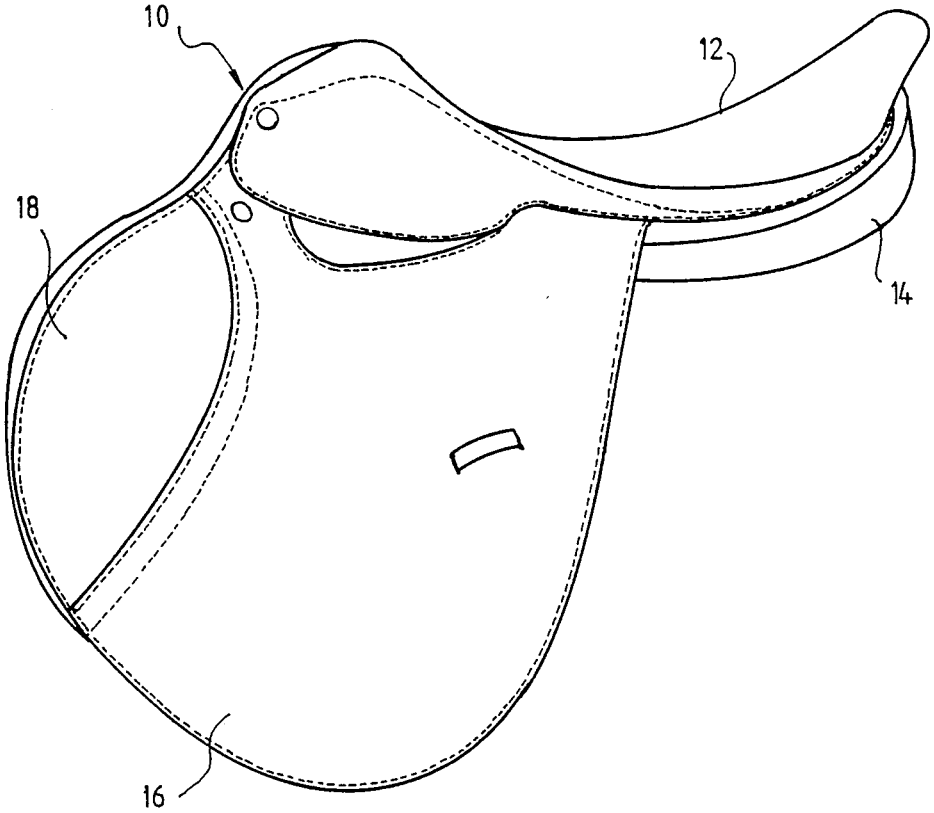
FIG. 1 is a diagrammatic view of a traditional leather saddle.

We begin with FIG. 1 which is a diagrammatic view of a traditional leather saddle.

This saddle 10 comprises an upper portion or seat 12 made of leather which is stretched over and fixed to a tree (not visible in the drawing), a stuffed and padded underportion 14 and flaps 16 having padded knee rolls 18 fixed thereon. As mentioned above, the tree is in general rigid in order to serve as a frame for the saddle and to ensure that the horse's withers are permanently disengaged. Webbing is stretched over the tree to support a cloth which in turn has the saddle's leather covering applied thereover.

A saddle of this type may be offered in various different sizes, i.e. with different lengths and with different widths of seat 12 and thus with different trees, thereby enabling the saddle to be adapted as much as possible to the size of the rider. The general shape and the curvature of the tree are determined to correspond to the shape of an average horse's back and thus constitute a compromise between the various different shapes of horse's back on which the saddle may be mounted.

Figure 2:
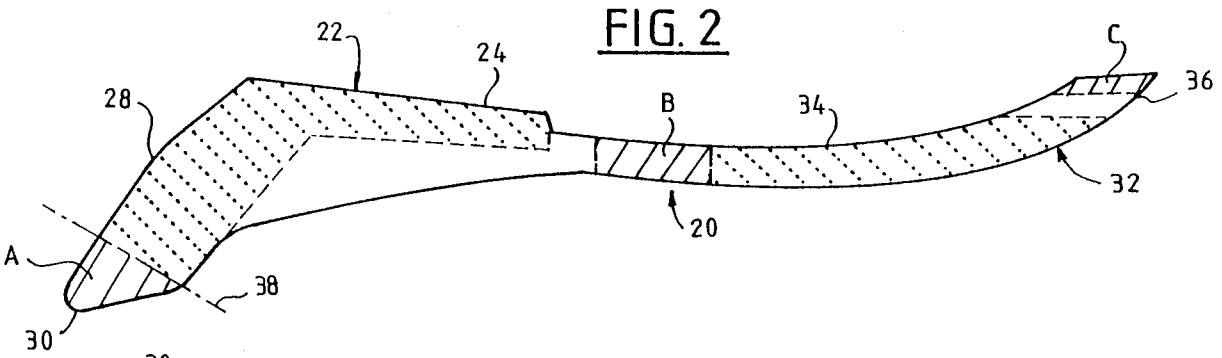
FIGS. 2 and 3 are respectively an elevation view and a plan view seen from above of a tree in accordance with the invention.
Figure 3:
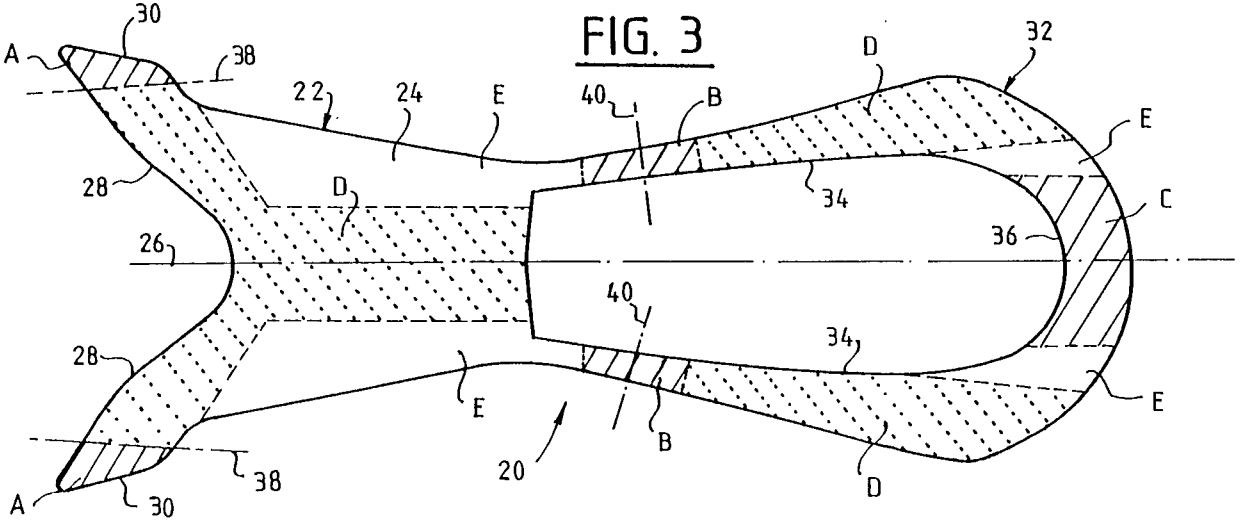

Reference is now made to FIGS. 2 and 3 which show a tree in accordance with the invention.

This tree 20 is made of a composite material by molding layers of cloth made of base fiber, e.g. glass fiber, together with layers of cloth made of reinforcing fiber, e.g. carbon fiber or the fiber sold under the trademark "KEVLAR", with the various different layers of fiber cloth being impregnated with a polymerizable or thermosetting resin such as an epoxy resin.

The front portion of the tree includes an arch 22 comprising a portion 24 which is curved about the longitudinal axis 26 of the tree and which is intended to surround the front portion of the horse's back, together with two forwardly and downwardly directed curved arms 28 which terminate in flat tabs or "points" 30. The curvature where the top ends of the two arms 28 meet the portion 24 of the arch is designed to ensure that the horse's withers are permanently disengaged.

The rear portion 32 of the tree is substantially U-shaped with curved branches 34 which are connected at their front ends to the rear portion of the arch 22 by being integrally formed therewith, and with a base 36 which is curved about the longitudinal axis 26 of the arch and which is connected to the rear ends of the branches 34 via two circular arcs.

In this embodiment the total length of the tree is about 45 centimeters and the various portions of the tree 20 have an average thickness of about 10 millimeters. In general, the tree is substantially rigid and undeformable, except for predetermined zones of controlled flexibility which are designated by references A, B, and C. The flexibility zones A are situated at the forward ends of the arms 28 of the arch and constitute the flat tabs or "points" 30 which are intended to be applied against the sides of the horse and which must be capable of opening outwardly and of closing inwardly by bending about a slanting axis 38 in order to adapt to the shape of a given horse's back.

The flexibility zones B are situated in the front end portions of the branches 34 of the rear portion of the tree, close to where they join the arch 22, and they enable bending about respective substantially transverse axes 40 in order to adapt the tree to the curvature of the horse's back along its spine. Flexibility zone C constitutes the middle portion of the base 36 of the rear portion of the tree and allows bending substantially about the longitudinal axis 26 of the tree in order to adapt the shape of the rear portion of the tree to the width of the horse's back and to its curvature in this zone about the longitudinal axis of the tree.

The arch 22 includes a rigid and substantially undeformable portion designated by reference D and built up, for example, by superposing fifteen layers of glass fiber cloth together with four layers of reinforcing fiber cloth (e.g. cloth made of carbon fiber) with all of the layers being impregnated with epoxy resin. This rigid structure is repeated in the major portion of each branch 34 as indicated by the same references D. The flexibility zones A, B, and C include a smaller number of layers of glass fiber cloth and have no reinforcing fiber, with the layers of glass fiber cloth being disposed, for example, so that the fibers are oriented at 45° relative to the desired bending axis, and with the number of layers of glass fiber cloth in these zones being, for example, half the number of layers in the rigid zones D. The remainder of the tree, i.e. those portions which are designated by references E, may be constituted solely by layers of glass fiber cloth, e.g. by fifteen layers as in the rigid zones D.

In order to fabricate the tree, the layers of glass fiber cloth and of reinforcing fiber cloth are cut out to the desired shapes and sizes and are placed in a mold after being positioned and oriented as a function of the zones of rigidity and flexibility that are to be obtained. These layers of fiber cloth are impregnated with a polymerizable resin. After the various layers of fiber cloth have been put into place, the mold is closed and the resin is polymerized by application of heat. After the tree has been unmolded, any resin flash that may exist around the tree should be eliminated and then the stirrup bars are fixed to the arms 28 of the arch by riveting.

Figure 4:
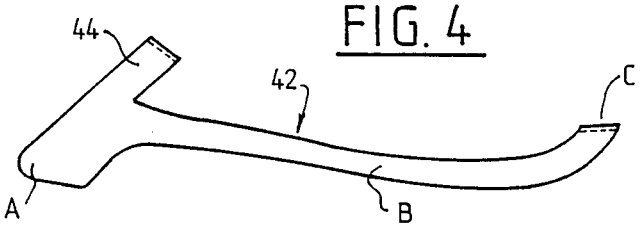
FIGS. 4 and 5 are views similar to FIGS. 2 and 3 respectively, but showing a variant embodiment of the tree.
Figure 5:
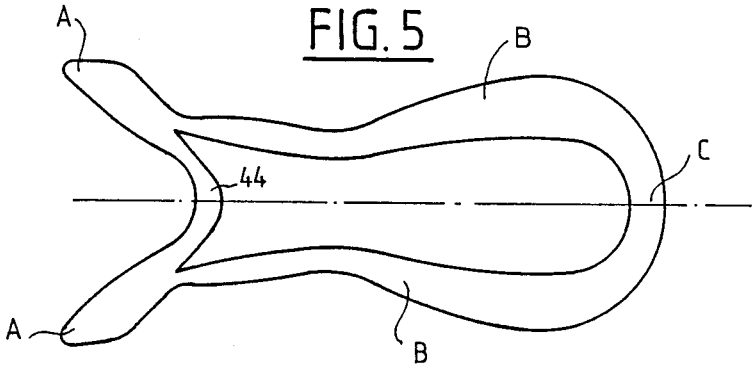
Figure 11:
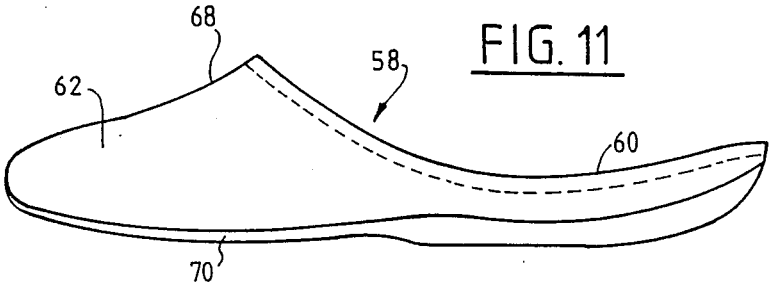
FIG. 11 is an elevation view of said top portion.

FIGS. 4 and 5 show a variant embodiment of the tree which is intended to constitute a part of a type of saddle which is different from that which includes the tree shown in FIGS. 2 and 3.

The tree 42 shown in FIGS. 4 and 5 has the same structure as the tree 20 shown in FIGS. 2 and 3 and is thus constituted by superposing layers of glass fiber cloth and layers of reinforcing fiber cloth in order to be substantially rigid while having zones A, B, and C of controlled flexibility. The tree 42 differs from the tree 20 in the shape of its arch 44 which is much shorter than the arch of the tree 20, and in the length of its U-shaped rear portion whose branches are connected directly to the side arms of the arch. In addition, the rear portion of the tree may have opposite curvature to the seat in order to optimize fitting on the horse's back.

In other variant embodiments, providing the top portion of the saddle is made of a cellular plastic material having adequate rigidity, as described below, the tree may include only the front half of the tree 20 shown in FIGS. 2 and 3.

The top portion and the underportion of the saddle between which the tree is located are shown in FIGS. 6 to 9 and 10 to 13 respectively. The top portion 46 constitutes the seat of the saddle and has substantially the same shape as the seat of a traditional leather saddle. However, it is made by thermocompression molding of a cellular plastic material such as polyethylene. More precisely, and as can be seen in the section views of FIGS. 8 and 9, this portion 46 comprises a core 48 of cellular plastic material having low or medium volumetric mass, e.g. about 50 kg/m$^3$, and thus having a degree of flexibility and a capacity for absorbing or damping shocks, and it is covered over its entire extent with a surface layer 50 of cellular plastic foam of higher density, e.g. twice as dense as the core 48. The bottom face 52 of this top portion 46 includes a housing or recess for receiving the tree, said recess being delimited by a relatively wide rim 54 which constitutes the outer edge of the top portion of the saddle and which is connected to the remainder of said top portion along its longitudinal sides by means of a zone 56 of reduced thickness.

The underportion 58 of the saddle as shown in FIGS. 10 to 13 is also made by thermocompression molding of cellular plastic material.

It comprises a central portion 60 which supports the tree and two side portions 62 constituting the flaps of the saddle. The top face of its central portion 60 may include a housing or hollowed recess for receiving and positioning the tree.

Figure 12:
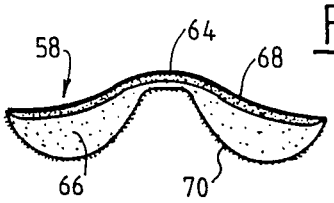
FIG. 12 is a section view on line XII—XII of FIG. 10.
Figure 9:
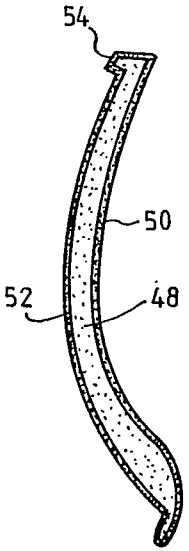
FIGS. 8 and 9 are sections on lines VIII—VIII and IX—IX respectively of FIG. 6.
Figure 7:
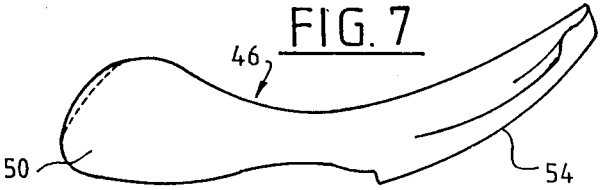
FIG. 7 is an elevation view of said top portion.
Figure 6:
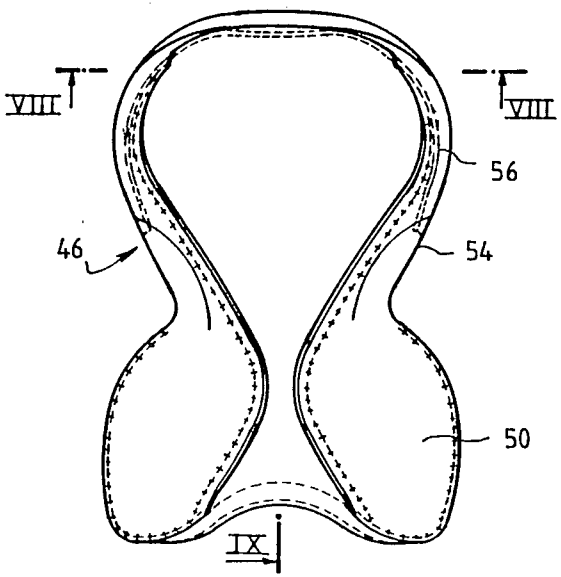
FIG. 6 is a plan view from above of the top portion of a saddle in accordance with the invention.
Figure 8:
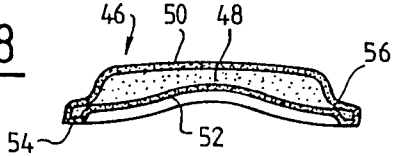
Figure 10:
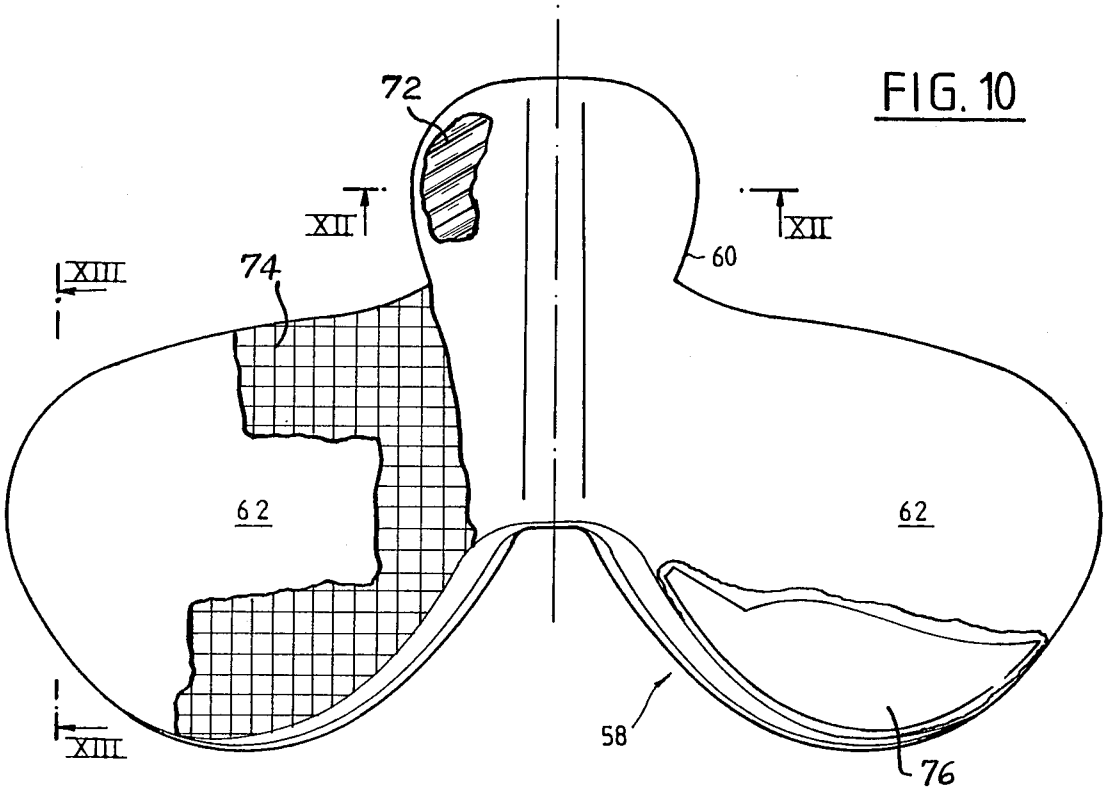
FIG. 10 is a top view of the bottom portion of the saddle laid out substantially flat.
Figure 13:
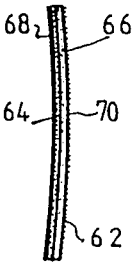
FIG. 13 is a section view on line XIII—XIII of FIG. 10.

As can be seen in the section views of FIGS. 12 and 13, this underportion 58 of the saddle comprises a relatively thin top layer 64 of low density cellular plastic material, and a thicker bottom layer 66 likewise of low density cellular plastic material. The top layer 64 may be made, for example, of pure polyethylene while the bottom layer 66 is made of polyethylene having a small proportion of elastomer added thereto. In addition, the top face of the layer 64 is coated with a thickness 68 of polyamide cloth while the bottom face of the layer 66 is lined with a thickness 70 of towelling or like cloth.

In order to assemble a saddle in accordance with the invention, the tree 20 is placed between the top portion 48 and the underportion 58 both made of cellular plastic material, and the top portion and the underportion are glued to the tree whose flat tabs or "points" 30 are glued in housings hollowed out to receive them in the flaps 62.

The saddle girth strap passes over the tree, i.e. between the arch of the tree and the top portion 48 of the saddle and extends over the flaps 62 of the bottom portion of the saddle in order to hold them against the sides of the horse. Padding 76 of cellular plastic material, similar to the knee rolls 18 on a conventional saddle as shown in FIG. 1, may be glued to the flaps 62 in order to cover the flexible tabs or "points" formed at the ends of the arch and in order to prevent them from leaving their housings formed in the flaps.

In general, the top portion 46 of the saddle overhangs the tree considerably in all directions, thereby firstly improving rider comfort and secondly enabling a single size of tree to be used for different sizes or types of saddle. When the tree is very short, the bottom face of the portion 52 may include stiffening ribs and/or longitudinal cavities 72 intended to be filled and stiffened by means of an injected plastic material.

At least one of the saddle portions made of plastic material may be formed with preferential fold zones or lines 74 in order to facilitate fitting the saddle on various sizes of horse.

A saddle in accordance with the invention has numerous advantages over traditional saddles:

it is thinner, lighter, and cheaper than a traditional saddle;

the tree distributes the weight of the rider uniformly over the horse's back and it adapts to the morphology of the horse;

it supports the stirrup bars and the saddle's girth strap in such a manner as to allow the longitudinal position of the saddle on a horse to be adjusted by moving the girth strap over the arch;

the top molded portion of the saddle adapts to the morphology of the rider and improves rider comfort and equilibrium;

by increasing the rigidity of the top molded portion, it is possible to use a very short tree;

the various curvatures of the top portion are independent from the curvatures of the tree and may be different therefrom, or located in different places;

the padding may be extended to taper over the first quarter of the flaps in order to provide a larger gripping surface than on a conventional saddle; and a single tree can be used for different sizes or for different types of saddle.

Naturally the invention is not limited to the embodiments described and shown which have been mentioned solely by way of example. The invention extends to any variant within the competence of the person skilled in the art and to technical equivalents thereof providing they fall within the scope of the following claims.

We claim:

1. A riding saddle having a tree including a rigid arch which is mounted between two thicknesses of flexible plastic material, one of which constitutes the seat portion of the saddle and the other of which constitutes the underside of the saddle and includes saddle flaps, said tree being formed in one piece by a thin strip of composite material which is rigid and substantially undeformable over the major portion of the tree, in particular at the arch, and which has controlled flexibility in predetermined zones in order to adapt to the morphology of a horse, said tree further including a rear portion integrally formed with the arch and substantially in the form of a rigid curved U-shape having flat branches which include zones of controlled flexibility about respective substantially transverse axes in the vicinity of their connections to the arch in order to adapt to the curvature of the horse's back along its spine, and wherein the rear end of the tree constituted by the base of the curved U-shape includes a middle zone of determined flexibility about the longitudinal axis of the tree in order to adapt to the width of the horse's back.

2. A riding saddle having a tree including a rigid arch which is mounted between two thicknesses of flexible plastic material, one of which constitutes the seat of the saddle and the other of which constitutes the underside of the saddle and includes saddle flaps, said tree being formed in one piece by a thin strip of composite material which is rigid and substantially undeformable over the major portion of the tree, in particular at the arch, and which has controlled flexibility in predetermined zones in order to adapt to the morphology of a horse, and wherein the tree is constituted by superposing layers of fibers which are assembled and bonded together by a polymerizable resin including layers of glass fiber cloth, and layers of carbon fiber cloth, and wherein the flexible zones of the tree are defined, relative to the rigid zones to which they are connected, by reducing the number of layers of base fiber, optionally by giving a particular orientation to the base fibers, and by omitting the reinforcing fibers.

3. A riding saddle having a tree including a rigid arch which is mounted between two thicknesses of flexible plastic material, one of which constitutes the seat of the saddle and the other of which constitutes the underside of the saddle and includes saddle flaps, said tree being formed in one piece by a thin strip of composite material which is rigid and substantially undeformable over the major portion of the tree, in particular at the arch, and which has controlled flexibility in predetermined zones in order to adapt to the morphology of a horse, said tree further including a rear portion integrally formed with the arch and substantially in the form of rigid curved U-shaped elongated branches and wherein the rear end of the tree constitutes the base of the curved U-shaped elongated branches and includes a middle zone of predetermined flexibility about the longitudinal axis of the tree in order to conform to the width of the horse's back.

4. A saddle according to claim 3, wherein two of said zones are situated at the front side ends of the arch and constitute flexible flat tabs or "points" applied against the flaps.

5. A saddle according to claim 3, wherein the tree is shorter and narrower in size than the seat of the saddle, and has different curvatures.

6. A saddle according to claim 3, wherein the tree is constituted by superposing layers of fibers which are assembled and bonded together by a polymerizable resin, including layers of glass fiber cloth, and layers of carbon fiber cloth.

7. A saddle according to claim 3, wherein the seat portion of the saddle is locally fixed to the tree and to the underside of the saddle.

8. A saddle according to claim 3, wherein the inside face of the seat portion of the saddle includes longitudinal stiffening grooves capable of being filled with an injected rigid plastic material.

9. A saddle according to claim 3, wherein at least one of the thicknesses of flexible plastic material in the saddle includes preferential fold lines facilitating fitting the saddle to different sizes of horse.

10. A saddle according to claim 3, wherein padding of flexible cellular plastic material is fixed to the flaps to cover and close housings hollowed in the flaps in order to receive the end tabs or "points" of the arch.

11. A saddle according to claim 3, wherein the arch includes means to support stirrup bars and a girth strap, which girth strap passes over a portion of the arch and over the flaps, and is adjustable in longitudinal position over the arch.

12. A method of manufacturing a saddle according to claim 3, consisting of the steps of placing various layers of base fiber cloth and of reinforcing fiber cloth which are cut out to the desired shapes and sizes in a mold having the shape of the tree to be obtained, impregnating said layers of cloth with a polymerizable resin in predetermined locations and orientations corresponding to the zones of rigidity and to the zones of flexibility to be obtained, subsequently compressing the set of layers in the mold, and polymerizing the resin.

13. A method according to claim 12, comprising the steps of molding thicknesses of flexible plastic material onto the tree by injecting plastic material into a mold containing the tree.

14. A method of manufacturing a saddle according to claim 3, including the steps of making the seat portion and the underside of the saddle by thermocompression molding of layers of cellular plastic material having different mechanical characteristics and then in locally fixing the top portion of the saddle to the tree and to the underside of the saddle.

15. A method according to claim 14, comprising the steps of molding a thickness of cloth over the layers of plastic material in order to form a cloth covering on at least one of the top and the bottom face of the underside of the saddle.

16. A riding saddle having a tree including a rigid arch which is mounted between two thicknesses of flexible plastic material, one of which constitutes the seat of the saddle and the other of which constitutes the underside of the saddle and includes saddle flaps, said tree being formed in one piece by a thin strip of composite material which is rigid and substantially undeformable over the major portion of the tree, in particular at the arch, and which has controlled flexibility along predetermined bending axes in predetermined zones in order to adapt to the morphology of a horse, and wherein the tree is constituted by superposing layers of fibers which are assembled and bonded together by a polymerizable resin including layers of glass fiber cloth, and wherein the flexible zones of the tree are obtained, relative to the rigid zones to which they are connected, by reducing the number of layers of fibers, and by giving a particular orientation to the fibers in the vicinity of 45° relative to the axis of the flexible zones.

* * * * *